US007343965B2

(12) United States Patent
Memory et al.

(10) Patent No.: US 7,343,965 B2
(45) Date of Patent: Mar. 18, 2008

(54) BRAZED PLATE HIGH PRESSURE HEAT EXCHANGER

(75) Inventors: Stephen B. Memory, Kenosha, WI (US); Jianmin Yin, Kenosha, WI (US); Tao Jia, New Berlin, WI (US); Milisav Lazarevic, Racine, WI (US); Roland Strähle, Untereneingen (DE)

(73) Assignee: Modine Manufacturing Company, Racine, WI (US)

( * ) Notice: Subject to any disclaimer, the term of this patent is extended or adjusted under 35 U.S.C. 154(b) by 423 days.

(21) Appl. No.: 10/760,579

(22) Filed: Jan. 20, 2004

(65) Prior Publication Data

US 2005/0155749 A1 Jul. 21, 2005

(51) Int. Cl.
*F28F 3/08* (2006.01)

(52) U.S. Cl. ..... 165/167; 165/166; 62/467

(58) Field of Classification Search ..... 62/467, 62/903; 165/166, 167, 176
See application file for complete search history.

(56) References Cited

U.S. PATENT DOCUMENTS 5,787,975 A * 8/1998 Grenier et al. ..... 165/166
5,857,517 A * 1/1999 Grenier et al. ..... 165/166
5,904,205 A * 5/1999 Grenier et al. ..... 165/166
2003/0015310 A1 1/2003 Dienhart et al.
2003/0094271 A1 5/2003 Leuthner et al.
2003/0102113 A1* 6/2003 Memory et al. ..... 165/176
2003/0183378 A1* 10/2003 Memory et al. ..... 165/176
2004/0026071 A1 2/2004 Hesse et al.

FOREIGN PATENT DOCUMENTS

DE 101 10 828 A1 9/2001
DE 100 35 939 A1 2/2002
DE 101 60 380 A1 6/2003
EP 0 932 011 A2 7/1999
FR 2 850 740 A1 8/2004

* cited by examiner

*Primary Examiner*—Ljiljana Ciric
(74) *Attorney, Agent, or Firm*—Michael Best & Friedrich LLP

(57) ABSTRACT

A brazed plate heat exchanger (30) is provided for transferring heat between a first fluid (32) and a second fluid (34), with the first fluid (32) being pressurized to a relatively high pressure. The heat exchanger includes plate pairs (41), with each pair (41) defining a plurality of flow channels (56) for the first fluid (32). Each of the flow channels (56) has a hydraulic diameter less than 1 mm. Reinforcements (62) are provided between each of the plate pairs (41) and are aligned with inlet and outlet openings (46,48) to define inlet and outlet manifolds (50,52) for the first fluid (32).

17 Claims, 9 Drawing Sheets

BRAZED PLATE HIGH PRESSURE HEAT EXCHANGER

FIELD OF THE INVENTION

This invention relates to brazed plate heat exchangers, and more particularly to brazed plate heat exchangers wherein one of the working fluids passing through the heat exchanger has a pressure greater than 1000 psi, such as in heat exchanger used in transcritical cooling systems.

BACKGROUND OF THE INVENTION

Brazed plate heat exchangers are commonly used for oil coolers and to a lesser extent are known for use in refrigeration systems. Because of their compactness, such heat exchangers are desirable for use in systems having a limited installation envelope, such as in vehicular applications. One drawback to conventional brazed plate heat exchangers is that their construction does not lend itself to high pressure applications where, for example, the operating pressures can be 1000 psi to 2000 psi or greater and the burst pressure requirements can be in the range of around 4000 psi to around 6000 psi. In this regard, conventional brazed plate heat exchangers are typically limited to less than 1000 psi. This has prevented the use of such heat exchangers in high pressure systems, such as for example, transcritical cooling systems that use a refrigerant such as carbon dioxide ($CO_2$).

Increasing environmental concerns over the use of many conventional refrigerants such as $CFCl_2$ and, to a lesser extent HFC134a, has led to consideration of transcritical $CO_2$ systems for use in vehicular applications, heat pumps, water heaters, and refrigeration systems. For one, the $CO_2$ utilized as a refrigerant in such systems could be claimed from the atmosphere or from waste products of other industrial processes at the outset with the result that if it were to leak from the system back to the atmosphere, there would be no net increase in atmospheric $CO_2$ content. Moreover, while $CO_2$ is undesirable from the standpoint of a greenhouse effect, it does not affect the ozone layer and would not cause an increase in the greenhouse effect since there would be no net increase in the atmospheric $CO_2$ content as a result of the leakage.

SUMMARY OF THE INVENTION

It is the principle object of the invention to provide a new and improved brazed plate heat exchanger that can be used with high pressure working fluids, such as supercritical $CO_2$.

According to one aspect of the invention a brazed plate heat exchanger is provided for transferring heat between a first fluid and a second fluid, wherein the first fluid is pressurized to greater than 1000 psi. The brazed plate heat exchanger includes a plurality of plate pairs to define flow paths for the first fluid, a plurality of turbulator plates interleaved between the plate pairs to define flow paths for the second fluid, each of the turbulator plates sandwiched between the plate pairs to provide structural support thereto, and reinforcements extending between each of the plate pairs. Each plate pair encloses a plurality of flow channels extending from a first inlet opening to a first outlet opening, with each of the flow channels having a hydraulic diameter less than 1 mm. The plate pairs are arranged as a stack with the first inlet openings being aligned with each other to define a first inlet manifold for distributing the first fluid to the flow channels, and the second openings aligned with each other to define a first outlet manifold for collecting the first fluid from the flow channels. The reinforcements are aligned with the first inlet and outlet openings and define the first inlet and outlet manifolds between the plate pairs.

In one aspect of the invention, the reinforcements are a plurality of washers interleaved between the plate pairs. In a further aspect, the first inlet and outlet openings are circular openings and each of the washers includes an annular step that is received in a corresponding one of the first inlet and outlet openings.

According to one aspect of the invention, pairs of channeled plates are sandwiched between the plates of each of the plate pairs, with grooves extending through each of the channeled plates to define the flow channels with the grooves of the other channeled plate of the pair.

In one aspect, the plates of each of the plate pairs are drawn-cup plates, and one of the plates of each of the plate pairs is dimpled to define the flow channels.

According to one aspect, the first inlet and outlet openings are circular openings, and the reinforcements include a cylindrical inlet header tube extending through the first inlet openings with an outer surface of the inlet header tube brazed to a surrounding periphery of the inlet openings in each of the plates of each of the plate pairs, and a cylindrical outlet header tube extending through the first outlet openings with an outer surface of the outlet header tube brazed to a surrounding periphery of the outlet openings in each of the plates of each of the plate pairs. In a further aspect, each of the header tubes includes a plurality of slots, with each of the slots aligned with the flow channels of a corresponding plate pair.

In one aspect, each of the plate pairs further includes a pair of sealed openings extending through the plate pair, with one of the pair of sealed openings in each of the plate pairs being aligned with the one of the pair of sealed openings in the adjacent plate pairs to define a second inlet manifold to distribute the second fluid to the flow paths for the second fluid, and the other of the pair of sealed openings in each of the plate pairs being aligned with the other of the pair of sealed openings in the adjacent plate pairs to define a second outlet manifold to collect the second fluid from the flow paths for the second fluid.

In one aspect of the invention, the brazed plate heat exchanger further includes a top plate defining an upper exterior of the heat exchanger, a turbulator plate sandwiched between the top plate and an upper-most one of the plate pairs to define flow channels for the second fluid and provide structural support to the plate pairs, a bottom plate defining a lower exterior of the heat exchanger, and a turbulator plate sandwiched between the bottom plate and a lower-most one of the plate pairs to define flow channels for the second fluid and provide structural support to the plate pairs.

According to one aspect of the invention, a brazed plate heat exchanger is provided for transferring heat between a first fluid and a second fluid, with the first fluid being pressurized to greater than 1000 psi. The brazed plate heat exchanger includes a plurality of flat plate subassemblies, a plurality of turbulator plates interleaved between the subassemblies to define flow paths for the second fluid, the turbulator plates sandwiched between the subassemblies to provide structural support thereto, and a plurality of solid washers interleaved between the subassemblies to provide structural support thereto. Each of the subassemblies includes a pair of outer flat plates and a pair of channeled plates sandwiched between the outer plates, with each of the plates having an inlet opening and an outlet opening spaced from the inlet opening. The inlet openings are aligned with each other to define a first inlet manifold, and the outlet openings aligned with each other to define a first outlet manifold. Each of the channeled plates includes a plurality of grooves that cooperate with the grooves of the other channeled plate of the pair to define a plurality of flow channels for the first fluid extending between the inlet openings to the outlet openings of the pair. The washers are aligned with the inlet and outlet openings, with the washers that are aligned with the inlet openings defining the first inlet manifold between the subassemblies, and the washers that are aligned with the outlet openings defining the first outlet manifold between the subassemblies.

In one aspect, the inlet and outlet openings in the outer plates are circular openings and each of the washers includes an annular step that is received in a corresponding one of the inlet and outlet openings in the outer plates without extending through the outer plate.

According to one aspect, the grooves in one of the channeled plates of each pair extend longitudinally between the inlet and outlet openings, and the grooves in the other channeled plate of the pair extend transverse to the grooves in the one of the channeled plates.

In one aspect of the invention, each of the subassemblies further includes a pair of sealed openings extending through the subassembly. One of the pair of sealed openings in each of the subassemblies is aligned with the one of the pair of sealed openings in the adjacent subassemblies to define a second inlet manifold to distribute the second fluid to the flow paths for the second fluid, and the other of the pair of sealed openings in each of the subassemblies being aligned with the other of the pair of sealed openings in the adjacent subassemblies to define a second outlet manifold to collect the second fluid from the flow paths for the second fluid. According to a further aspect, the brazed plate heat exchanger further includes a plurality of spacer plates interleaved between the subassemblies, with each of the spacer plates sandwiched between an adjacent pair of the subassemblies and surrounding the turbulator plate and the washers sandwiched between the adjacent pair to enclose a flow space for the second fluid.

According to one aspect of the invention, the brazed plate heat exchanger further includes a top plate defining an upper exterior of the heat exchanger, a turbulator plate sandwiched between the top plate and an upper-most one of the subassemblies to define flow channels for the second fluid and provide structural support to the subassemblies, a bottom plate defining a lower exterior of the heat exchanger, and a turbulator plate sandwiched between the bottom plate and a lower-most one of the subassemblies to define flow channels for the second fluid and provide structural support to the subassemblies.

In one aspect of the invention, each of the turbulator plates is a lanced and offset fin.

According to another aspect of the invention, a transcritical cooling system is provided and includes a working fluid flow loop, a compressor connected to the working fluid flow loop to receive the working fluid therefrom and to compress the working fluid to a supercritical pressure for delivery back to the working fluid flow loop, and a brazed plate heat exchanger connected to the working fluid flow loop to receive the working fluid therefrom and return the working fluid thereto. The brazed plate heat exchanger includes a plurality of brazed, stacked plate subassemblies that define high pressure flow paths for the working fluid. The brazed plate subassemblies are interleaved with another set of flow paths for another fluid to transfer heat between the working fluid and the other fluid.

In one aspect, each of the subassemblies comprise a pair of mating drawn-cup plates.

According to one aspect, each of the subassemblies comprises a pair of outer flat plates and a pair of channeled plates sandwiched between the outer flat plates.

Other features, aspects, objects, and advantages of the invention will become apparent from a complete reading of the Specification, including the appended drawings and claims.

DETAILED DESCRIPTION OF THE PREFERRED EMBODIMENT

Figure 1:
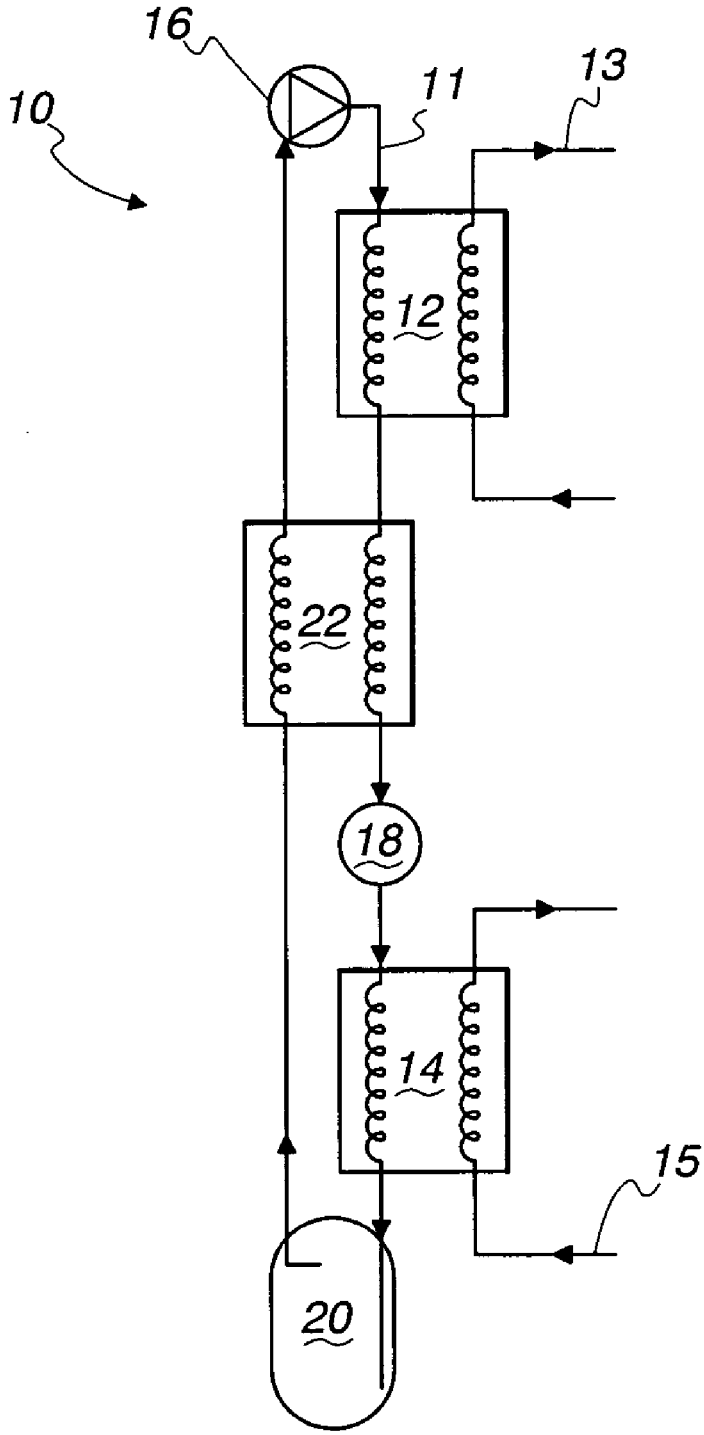
FIG. 1 is a diagrammatic representation of a transcritical cooling system that can incorporate a brazed plate heat exchanger according to the invention.

With reference to FIG. 1, a transcritical cooling system 10, which uses a refrigerant or working fluid 11, such as $CO_2$, includes a gas cooler 12 that provides supercritical cooling to the refrigerant 11 by rejecting heat to a cooling medium 13; an evaporator 14 that transfers heat from a hot medium 15 to the refrigerant 11 to vaporize the liquid phase of the refrigerant 11 from the liquid phase to the gaseous phase; a compressor 16 that compresses gaseous phase refrigerant 11 to a supercritical pressure for delivery to the gas cooler 12; an expansion device 18 that reduces the pressure in the refrigerant 11 received from the gas cooler 12 so at least some of the refrigerant 11 enters the liquid phase; an accumulator 20 (optional) that collects the refrigerant 11 from the evaporator 14 and delivers gas phase refrigerant 11 to the remainder of the system 12; and a suction line heat exchanger 22 (optional) that transfers heat from the refrigerant 11 exiting the gas cooler 12 to the refrigerant exiting the evaporator 14, or accumulator 20 if used. As shown in the system 10, heat exchangers embodying the present invention can be used for either or both the gas cooler 12 and the evaporator 14. However, it should be understood heat exchangers embodying the present system may find use in other configurations of cooling systems that perform a transcritical cooling cycle and in other types of systems that utilize relatively high pressures, i.e. operating pressures greater than 1000 psi. Accordingly, the disclosed heat exchangers are not limited to use with the specific cooling system 10 shown in FIG. 1. Further, it should be understood that heat exchangers embodying the present invention can be adapted for a large variety of purposes wherein one of the working fluids operates at a relatively high pressure.

Having described a typical operating environment for heat exchangers embodying the present invention, a more detailed description will now be provided for one preferred embodiment of the heat exchangers.

Figure 2:
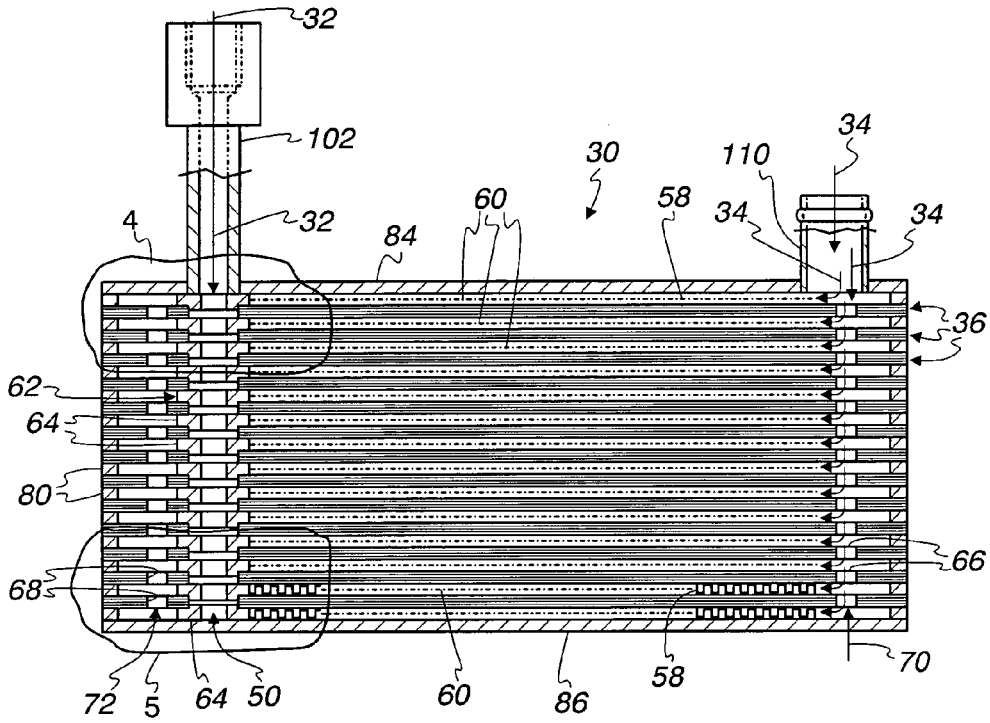
FIG. 2 is a side elevation shown in section of a heat exchanger embodying the present invention.
Figure 3:
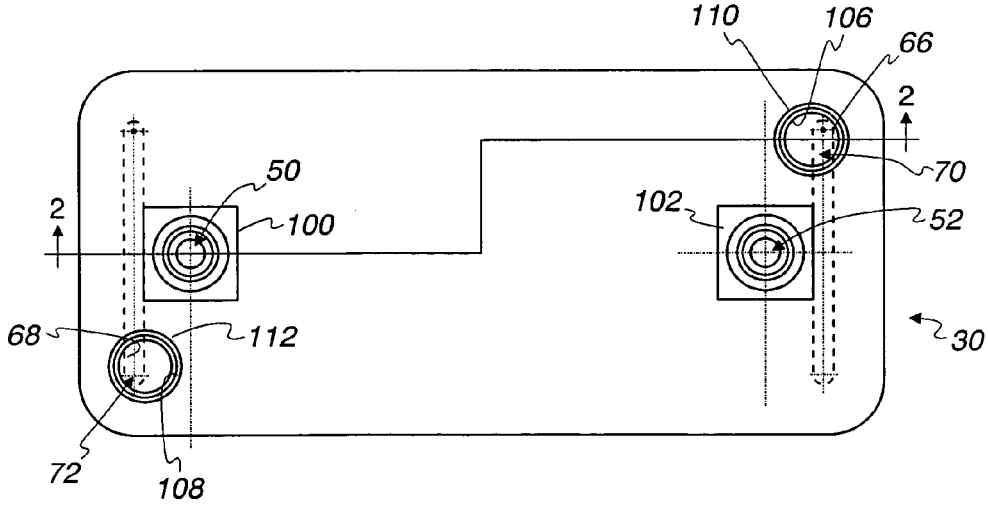
FIG. 3 is a top view of the heat exchanger of FIG. 2.
Figure 4:
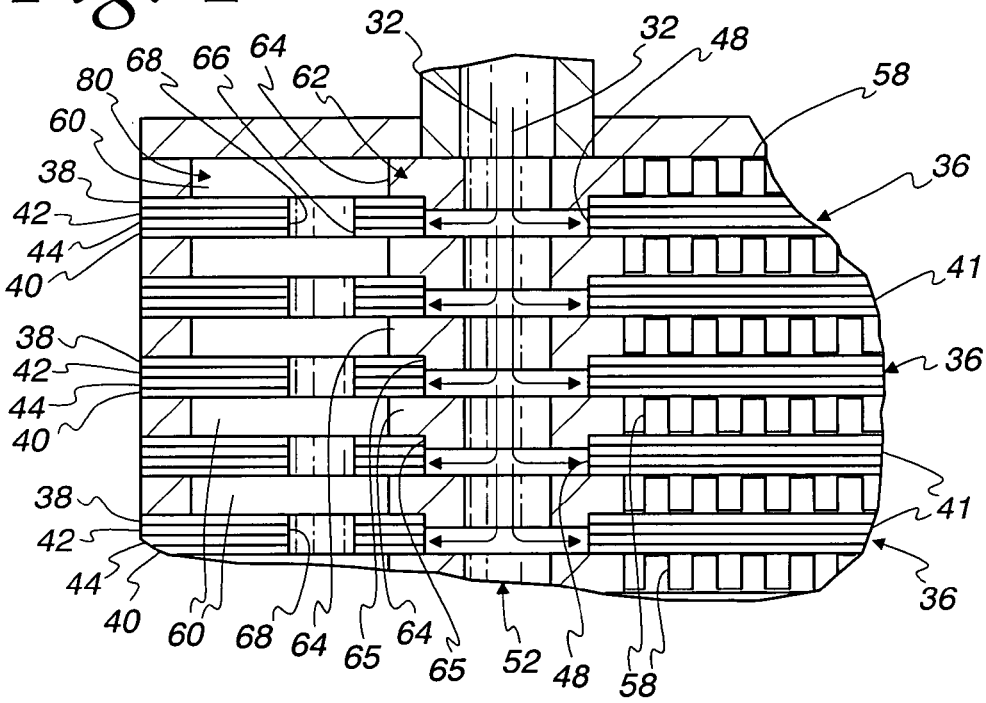
FIG. 4 is an enlarged view of the area encircled by line 4 in FIG. 2.
Figure 5:
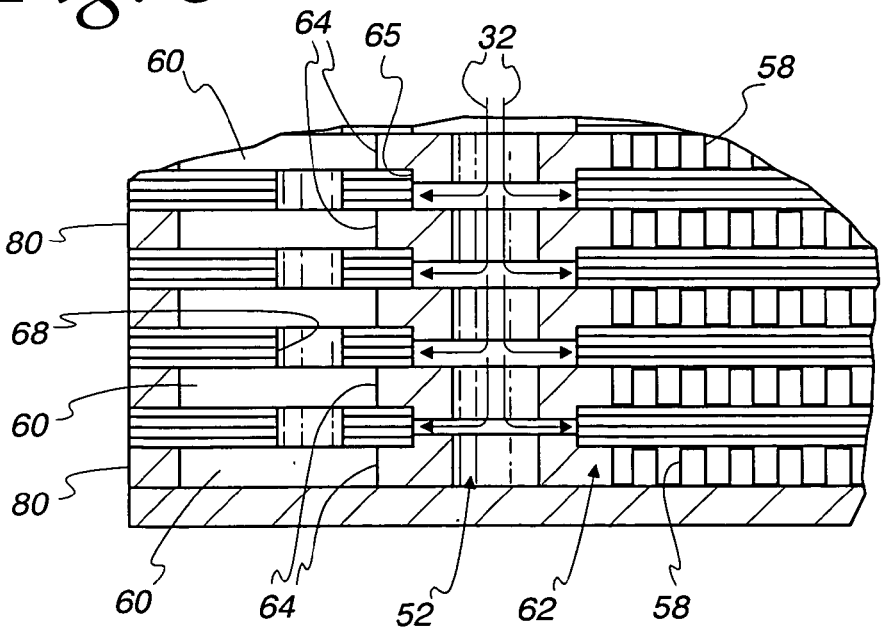
FIG. 5 is an enlarged view of the area encircled by line 5 in FIG. 2.
Figure 7:
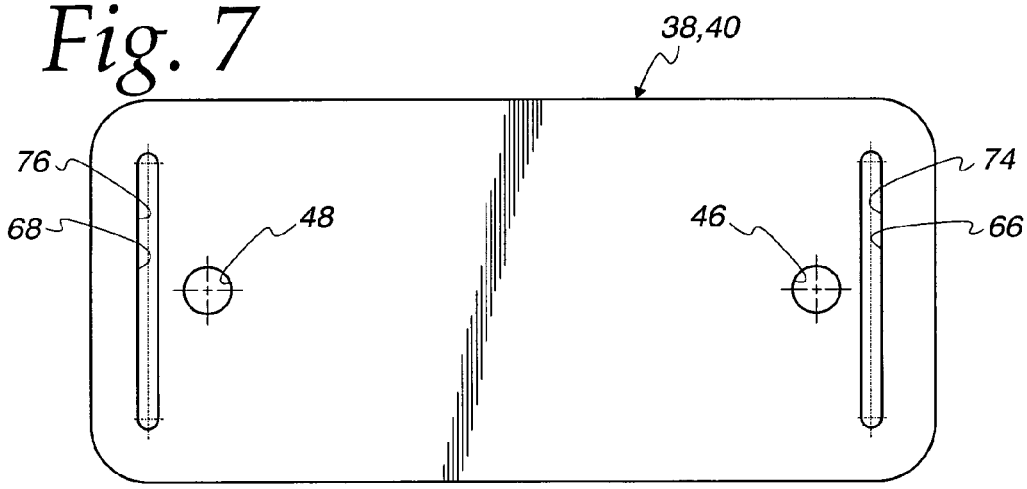
Figure 8:
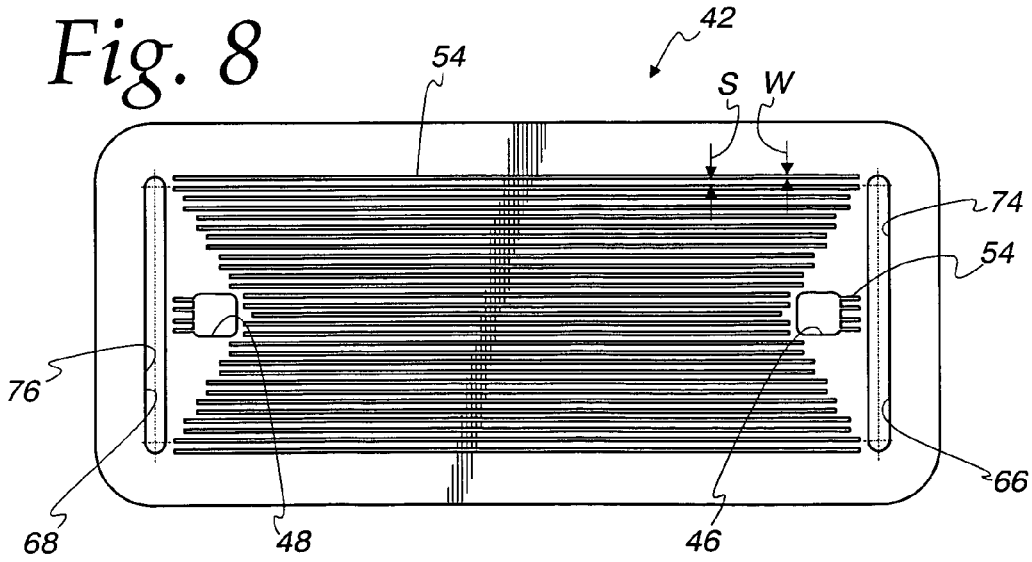
Figure 9:
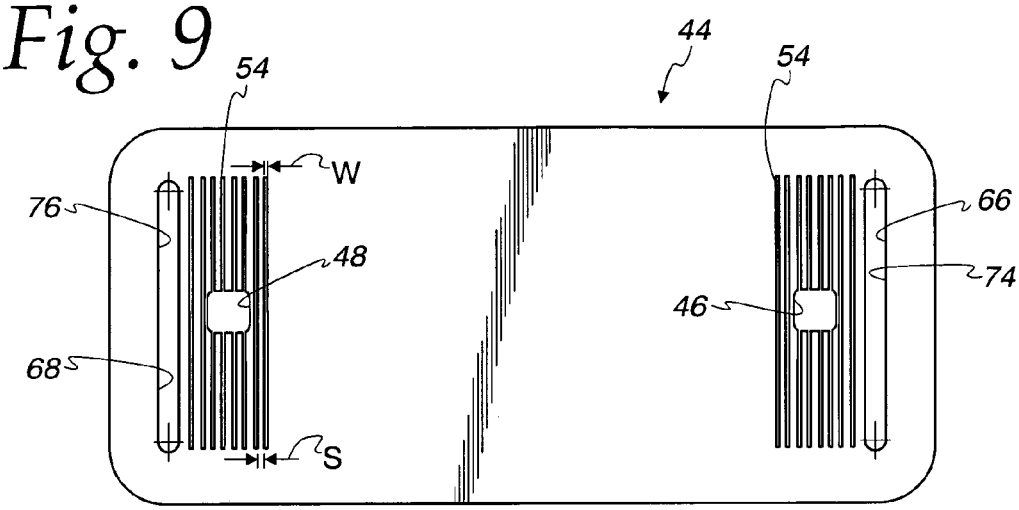

As seen in FIGS. 2 and 3, a brazed plate heat exchanger 30 embodying the present invention is provided for transferring heat between a first fluid such as a refrigerant $CO_2$, shown by arrows 32, and a second fluid, shown by arrows 34, with the first fluid 32 being pressurized to greater than 1000 psi, and in some systems having an operating pressure greater than 2000 psi. The heat exchanger 30 includes a plurality of flat plate subassemblies 36, with each of the subassemblies comprising a pair of outer flat plates 38, 40 and a pair 41 of channeled plates 42,44 sandwiched between the outer plates 38, 40. The flat, mating surfaces of the plates 38, 40, 42, and 44 are brazed together to form the subassembly 36, either by providing a suitable braze sheet between each of the plates 38, 40, 42, and 44 or by providing a clad braze coating on at least one of each pair of flat mating surfaces of the subassembly 36, and preferably on all of the flat, mating surfaces of the subassembly 36. The outer plates 38 and 40 are identical and are best seen in FIG. 7. As best seen in FIGS. 7-9, each of the plates 38, 40, 42, and 44 has an inlet opening 46 and an outlet opening 48 spaced from the inlet opening 46 The inlet openings 46 are aligned with each other to define a first inlet manifold 50 for the fluid 32, and the outlet openings 48 are aligned with each other to define a first outlet manifold 52 for the fluid 32.

Figure 12:
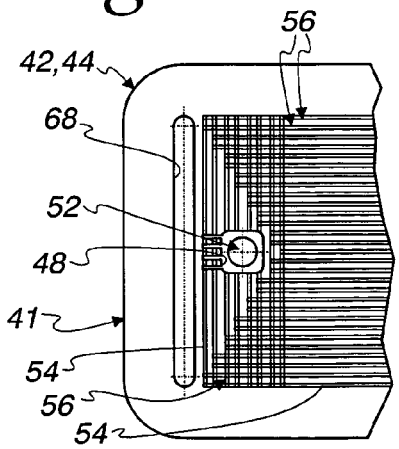
FIG. 12 is a partial, enlarged overlay view of the plate shown in FIGS. 8 and 9.
Figure 13:
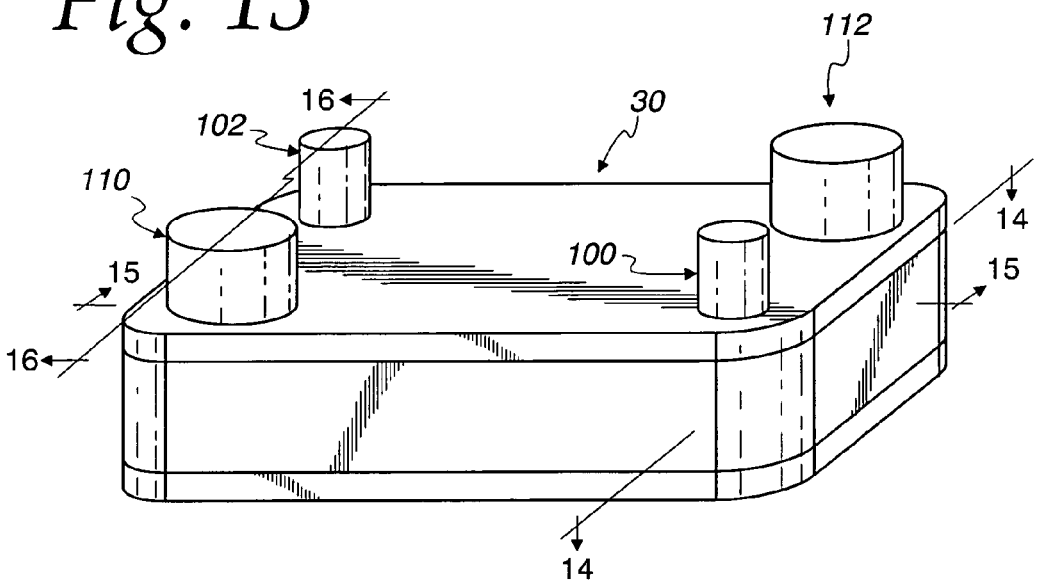
FIG. 13 is a diagrammatic perspective view of another version of a heat exchanger embodying the present invention.
Figure 14:
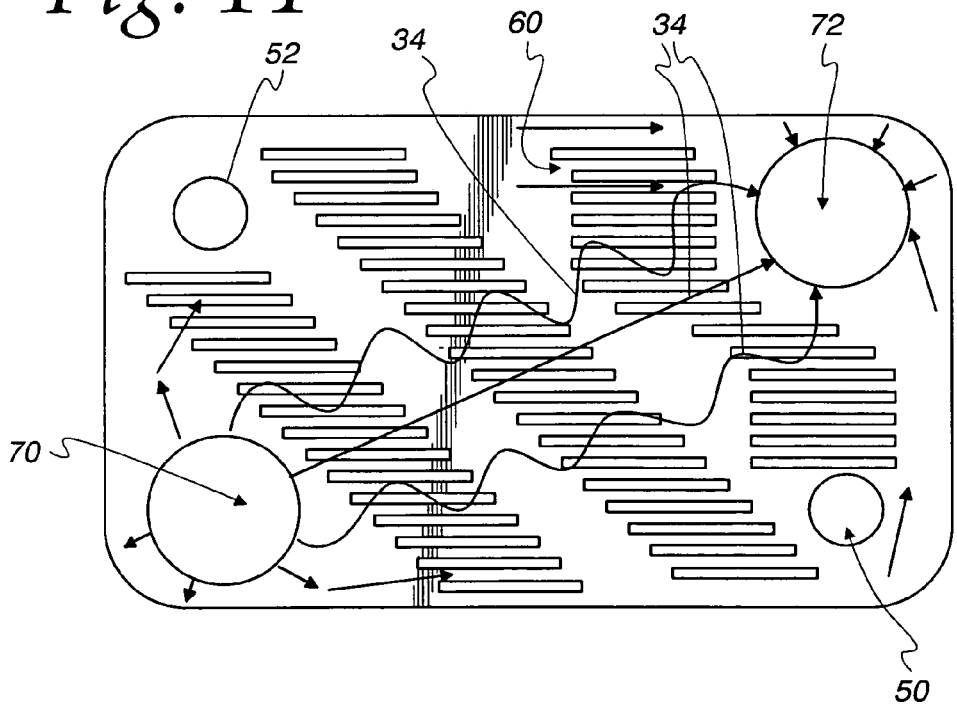
FIG. 14 is a diagrammatic view taken from line 14-14 in FIG. 13.
Figure 17:
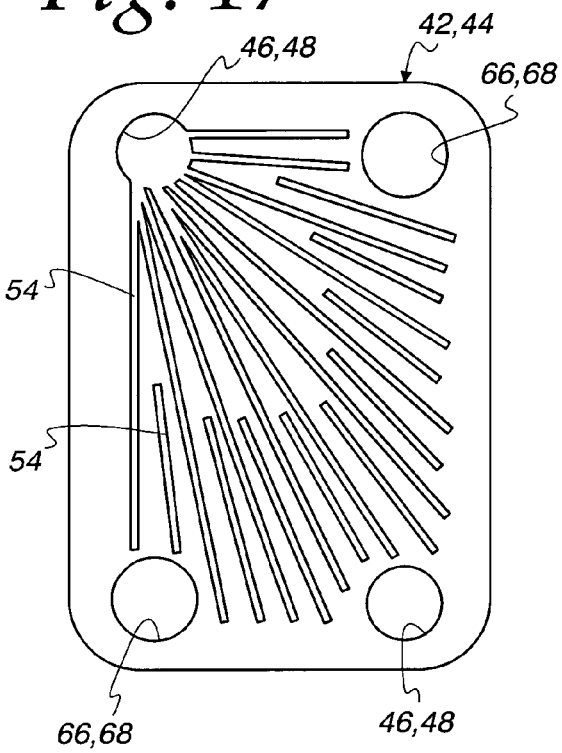
FIGS. 17 and 18 are top views of a pair of plates that can be utilized in the heat exchangers embodying the invention.
Figure 18:
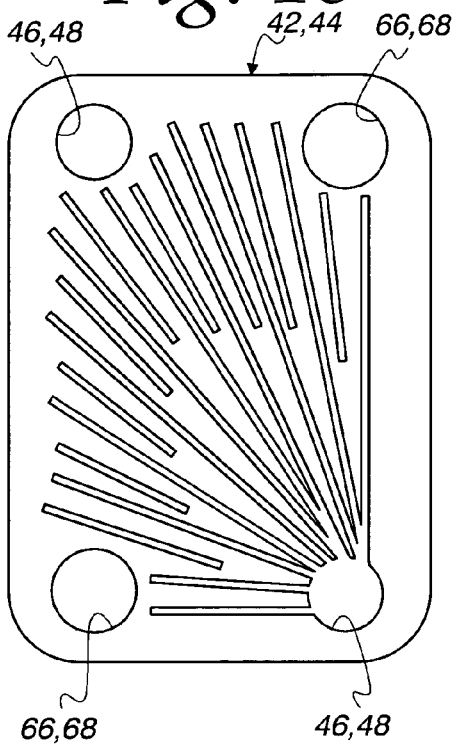
Figure 19:
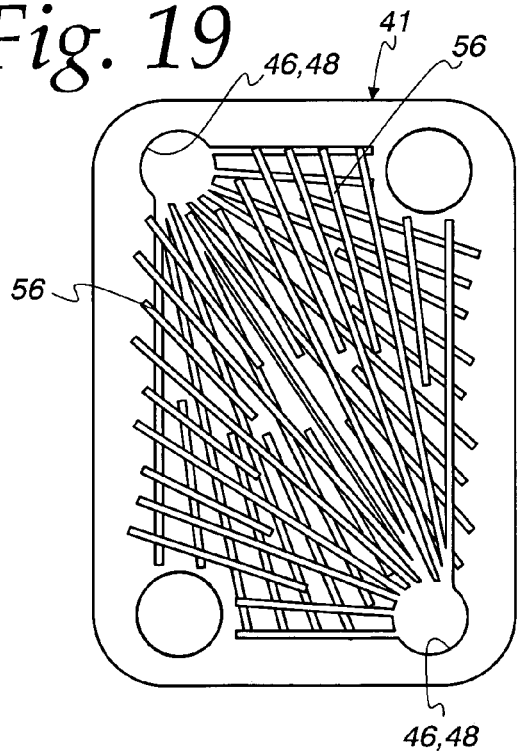
FIG. 19 is a top view showing the plate of FIGS. 17 and 18 overlaid on top of each other.

Each of the channel plates 42, 44 include a plurality of grooves 54 that extend through the thickness of the associated plate 42, 44, as best seen in FIGS. 8 and 9. In the assembled state, the grooves 54 cooperate with the grooves 54 of the other channel plate of the pair 41 to define a plurality of flow channels 56 for the first fluid 32 extending between the inlet openings 46 and the outlet openings 48 of the pair 41. The outer plates 38, 40 enclose the flow channels 56 defined by the grooves 54 when the plates 42, 44 are sandwiched between the outer plates 38, 40. As seen in FIGS. 8 and 9, in the illustrated embodiments, the grooves 54 in the plate 42 extend parallel to the length of the plate 42 and the grooves 54 in the plate 44 extend transverse to the length of the plate 44 so that, when the plates 42 and 44 are overlaid as shown in FIG. 12, the transverse grooves 54 in the plate 44 mate with the end portions of the longitudinal grooves 54 in plate 42 so as to form the flow channels 56 for directing the fluid 32 between the openings 46 and 48 and the manifolds 50 and 52. While a preferred arrangement of the grooves 54 is shown, it may be advantageous in some applications to provide other arrangements of the grooves depending upon the particular parameters of the application, such as for example, the relative location of the inlet and outlet manifolds 50 and 52, the fluid properties of the first fluid 32, and the size and shape of the heat exchanger 30. Another example of an acceptable groove pattern is shown in FIGS. 17-19, which will be discussed in more detail below.

Preferably, each of the flow channels 56 has a hydraulic diameter less than 0.04" or 1 mm, and the channels 54 are spaced a sufficient distance from each other so that when the plates 38, 40, 42, and 44 are brazed together to form the subassembly 36, there is sufficient brazed surface area to provide the structural support to withstand the high pressure force within the flow channels 56 which is limited by the small hydraulic diameter. In this regard, as one possible construction for the illustrated embodiment, each of the plates 38, 40, 42, and 44 could be made from 0.028" thick aluminum with a suitable amount of braze material clad on both sides of each of the plates 38, 40, 42, and 44, and each of the grooves 54 having a width W equal to 0.030" and a spacing S between adjacent grooves 54 equal to 0.060" in each of the plates 42 and 44. It should be understood, that the dimensions and spacing required for the grooves 54 will depend upon a number of factors, including but not limited to, the particular material chosen for the plates 38, 40, 42, and 44, the thickness of each of the plates 38, 40, 42, and 44, the operating and burst pressure of the first fluid 32, and the pattern of the grooves 54 in each of the plates 42 and 44. Furthermore, it should be appreciated that while in the illustrated embodiment, each of the plates 38, 40, 42, and 44 have the same thickness, in some applications it may be desirable for the thickness among the plates to vary.

The heat exchanger 30 further includes a plurality of turbulator plates 58 (only two partially shown in FIG. 2) interleaved between the sub-assemblies 36 to define flow paths 60 for the second fluid 34. It should be understood that the turbulator plate in only partially shown in FIG. 10 with the middle length of the plate not shown for purposes of illustration. Each of the turbulator plates is sandwiched between adjacent pairs of the subassemblies 36 preferably provided in the form of a lanced and offset turbulator plate, as shown by the rotated cross section of the turbulator plate provided in the center of FIG. 10 for purposes of illustration.

Reinforcements 62, in the form of a plurality of washers 64, are aligned with the inlet and outlet openings 46 and 48 and interleaved between the subassemblies 36 to provide structural support thereto, with the washers 64 that are aligned with the inlet openings 46 defining the inlet manifold 50 between the subassemblies 36, and the washers 64 that are aligned with the outlet openings 48 defining the outlet manifold 52 between the subassemblies 36. As seen in FIG. 7, each of the openings 46 and 48 in the outer plates 38, 40 is circular and is sized to closely receive an annular rim or shoulder 65 formed on each of the corresponding washers 64 so as to positively locate the washers 64 during assembly of the heat exchanger 30. As best seen in FIGS. 8 and 9, each of the openings 46 and 48 in the channeled plates 42, 44, in the illustrated embodiment has an approximately square shape with rounded corners with each side of the square being approximately or slightly greater than the diameter of the holes 46, 48 in the outer plates 38, 40 so as to also receive the shoulder 65 should it extend beyond the openings 46, 48 in the outer plates 38, 40.

Each of the subassemblies 36 further includes a pair of elongated sealed openings 66 and 68 extending through the subassembly 36, with the opening 66 in each of the subassemblies being aligned with the sealed openings 66 in the adjacent subassemblies 36 to define a second inlet manifold 70 to distribute the second fluid 34 to the flow paths 60, and the other sealed opening 68 in each of the subassemblies 36 being aligned with the other sealed openings 68 in the adjacent subassemblies 36 to define a second outlet manifold 72 to collect the second fluid 34 from the flow path 60. The sealed openings 66 and 68 are defined by individual openings 74 and 76, respectively, formed in each of the plates 38, 40, 42, and 44 that are sealed by the mating flat surfaces surrounding the openings 74, 76 when the plates 38, 40, 42 and 44 are brazed together.

Figure 10:
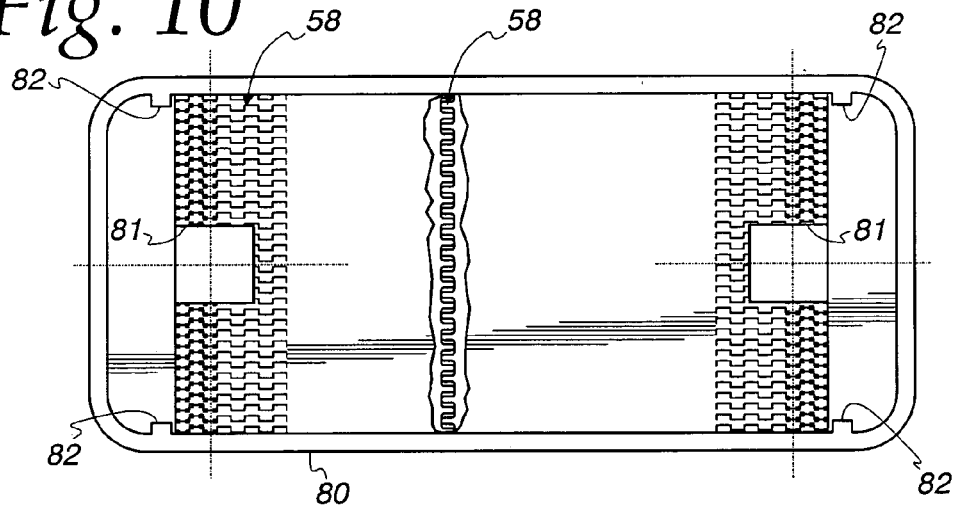
Figure 11:
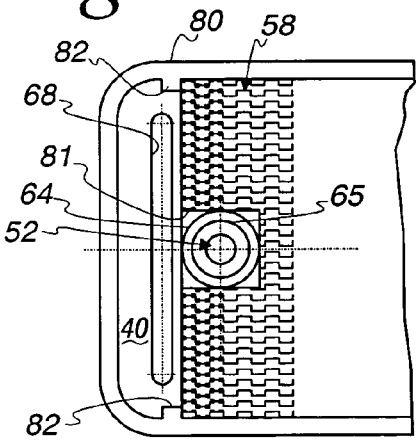
FIG. 11 is a partial, enlarged overlay view of the plates shown in FIGS. 7-10.

As best seen in FIGS. 1 and 10, the heat exchanger 30 further includes a plurality of spacer plates 80 interleaved between the subassemblies 36 and surrounding the turbulator plates 58 and the washers 64 to enclose the flow paths 60 for the second fluid 34. Preferably, the thickness of the spacer plates 80 should be the same as or just slightly less than the thickness of the turbulator plates 58 so that both the spacer plates 80 and the turbulator plates provide structural support to the subassemblies 36 when the heat exchanger 30 is assembled and brazed. As best seen in FIGS. 10 and 11, each of the turbulator plates 58 has a square shaped cut-out 81 formed in each of the opposite ends of the turbulator plate 58, with the dimension of the square being the same as or slightly greater than the largest outer diameter of the washer 64, again to assist in locating turbulator plates 58 and washers 64 during assembly. Additionally in this regard, each of the spacer plates 80 has four inwardly protruding tabs 82 that are spaced from each other by a length that is slightly greater than the length of each of the turbulator plates 58 to help locate the turbulator plates 58 during assembly.

Figure 6:
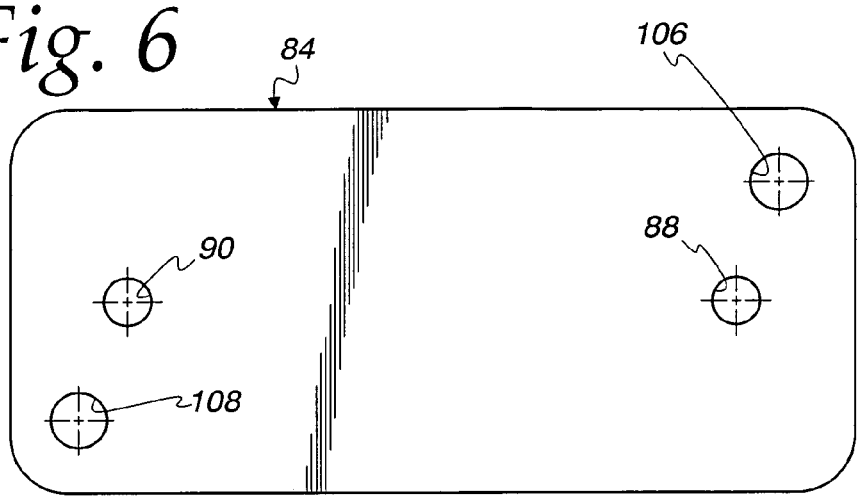
FIGS. 6-10 are enlarged top views, respectively, of plates used in the heat exchanger of FIG. 2.

The heat exchanger 30 also includes a top plate 84 defining an upper exterior of the heat exchanger 30 and a bottom plate 86 defining a lower exterior of the heat exchanger 30. As best seen in FIG. 6, the top plate 84 includes a pair of openings 88 and 90 that are aligned with the inlet manifolds 50 and 52, respectively, and are sized to receive fluid connector couplings 100 and 102, respectively (only one shown in FIG. 2) that are used as respective inlet and outlet ports for the refrigerant 32. The top plate 84 also includes a pair of openings 106 and 108 that are aligned with the manifolds 70 and 72, respectively, and are sized to receive respective connector couplings 110 and 112 which act as a respective inlet and outlet port for the second fluid 34. While particular forms are shown for the couplings 100, 102, 106, and 108 in the illustrated embodiment, it should be understood that there are many suitable forms for these couplings known to those skilled in the are and that the particular form chosen for a specific application will be highly dependent upon the parameters of the application. In the illustrated embodiment, the bottom plate 86 is a solid plate without any holes or perforations. An additional one of the turbulator plates 58 is sandwiched between the top plate 84 and an upper most one of the subassemblies 36 to define a flow channel 60 for the second fluid 34 there between and to provide structural support to the subassemblies 36. Another one of the turbulator plates 58 is sandwiched between the bottom plate 86 and a lower-most one of the subassemblies 36 to define the flow paths or channels 60 of the second fluid 34 there between and to provide structural support to the subassemblies 36. In this regard, one consideration in choosing the thickness of the plates 84 and 86 is that they be sufficiently thick to provide the required structural support for the subassemblies 36 as well as the remainder of the heat exchanger 30.

Figure 15:
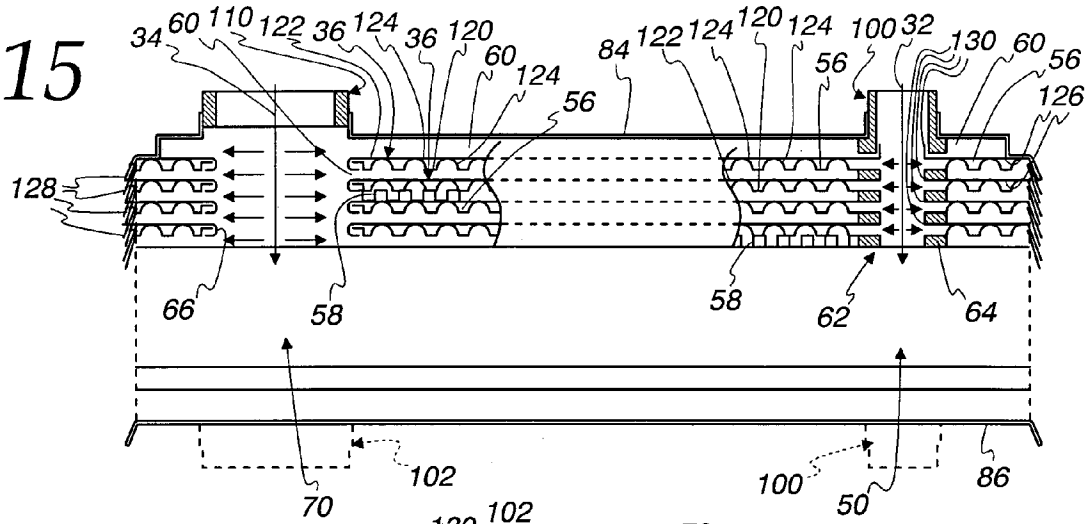
FIG. 15 is a section view taken from line 15-15 in FIG. 13.
Figure 16:
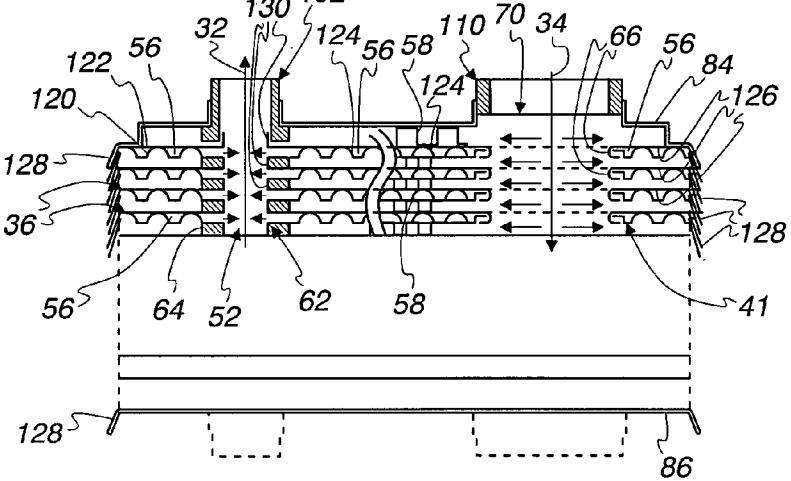
FIG. 16 is a section view taken from line 16-16 in FIG. 13.

Turning now to FIGS. 13-16, another embodiment of the heat exchanger 30 will be described with like numbers indicating like components except as explained in more detail below. In this embodiment of the heat exchanger 30, the subassemblies 36 are formed from a pair 41 of drawn-cup plates 120 and 122, with each of the plates 120 having a plurality of inwardly extending channel forming dimples 124 that mate with the inner surface 126 of the associated plate 122, which is flat, to form the flow channels 56 for the first fluid 32. Again, it is preferred that the dimples be sized so that the hydraulic diameter of the flow channels 56 is less than 0.04" or 1 mm. Accordingly, it should be appreciated that the dimples 124 in FIGS. 15 and 16 are shown greatly exaggerated and that in practice the height of the dimples will be very low to provide the desired small hydraulic diameter. As with the grooves 54 of FIGS. 2-12, the dimples 124 can be arranged in many different configurations to direct the first fluid 32 through the heat exchanger 30 from the inlet manifold 50 to the outlet manifold 52.

Preferably, each of the plates 120 and 122 includes a peripheral rim or lip 128 that is angled slightly outward so that the plates 120 and 122 and subassemblies 36 can be nested together in the assembled state to form the heat exchanger 30. This assists in the assembly and brazing of the heat exchanger 30 and increases the strength of each of the subassemblies 36. It should also be appreciated that each of the top plate 84 and bottom plate 86 has a similar rim 128 that can be nested with the rims of the subassemblies during assembly.

As in the embodiment of FIGS. 2-12, this embodiment includes turbulator plates 58 (only partially shown at selected locations in FIGS. 15 and 16) and washers 64 interleaved between each of the subassemblies 36. However, as best seen in FIGS. 15 and 16, the washer 64 do not have the annular step 65, but rather are located relative to the subassemblies 36 by annular flanges or lips 130 that surround the openings 46 and 48 and extend outwardly from each of the plates 122. Each of the lips 130 is received by the inside diameter of an associate one of the washers 64. Additionally, the subassemblies 36 include the openings 66 and 68 that are aligned to form the second inlet and outlet manifolds 70 and 72, but the openings 66 and 68 are circular rather than the elongated shape of the embodiment of FIGS. 1-13. Additionally, it is preferred that, in addition to a braze connection between the interior surfaces of the plates 120 and 122 surrounding the openings 66 and 68, there be a mechanical joint formed at each of the openings 66 and 68 between each of the plates 120 and 122 of the subassembly 36, such as by rolling the edge of the openings 66, 68 of one of the plates 120, 122 over the corresponding edge of the opening 66, 68 of the other of the plates 120, 122, as best seen in FIGS. 15 and 16, to enhance the sealing and strength at the openings 66 and 68. It will be appreciated by those skilled in the art that there are many possible mechanical joint configurations that are compatible with brazing and that will enhance the sealing and strength at the openings 66 and 68.

As best seen in FIGS. 15 and 16, while the connectors 100, 102, 110, and 112 are shown extending from the top of the heat exchanger 30, one of more of the connectors could be made to extend from the bottom of the heat exchanger 30 by putting a corresponding opening in the bottom plate 86. This is also true for the embodiment of FIGS. 2-12. It should also be appreciated that in comparing the embodiment of FIGS. 2-12 with the embodiment of FIGS. 13-16, that there are many possible ways locate the respective connectors 100, 102, 110, and 112 and the associate manifolds 50, 52, 70, and 72, and that the locations shown for the embodiment of FIGS. 2-12 can be used in the embodiment of FIGS. 13-16 and vise versa. In this regard, FIGS. 17 and 18 show another possible construction for the channel plates 42 and 44 wherein the grooves 54 extend out in a fan shaped pattern from each of the openings 46 and 48 of the plates 42 and 44. It should also be appreciated that the plates 42 and 44 of FIGS. 17 and 18 are actually identical with the plate 42, 44 of FIG. 18 simply showing the reverse and rotated view of the plate 42, 44 of FIG. 17. As best seen in FIG. 19, when the plates 42 and 44 are overlaid, the grooves 54 mate in such a way as to form the flow channels 56 extending between the openings 46 and 48 to transfer the first fluid 32 there between. It should be appreciated that in this embodiment, the openings 42, 46 and 66, 68 in the outer plates 38, 40 would correspond to the locations shown in FIGS. 17, 18, and 19.

It should also be appreciated that the plates shown in FIGS. 17-19 could be substituted for the dimples 124 in the plate 120 in the embodiments of FIGS. 15 and 16, while retaining the rims on each of the drawn-cup plates 120 and 122 so that each of the drawn-cup plates 120 and 122 become equivalent to the outer plates 38 and 40 of the embodiment of FIGS. 2-12.

Figure 20:
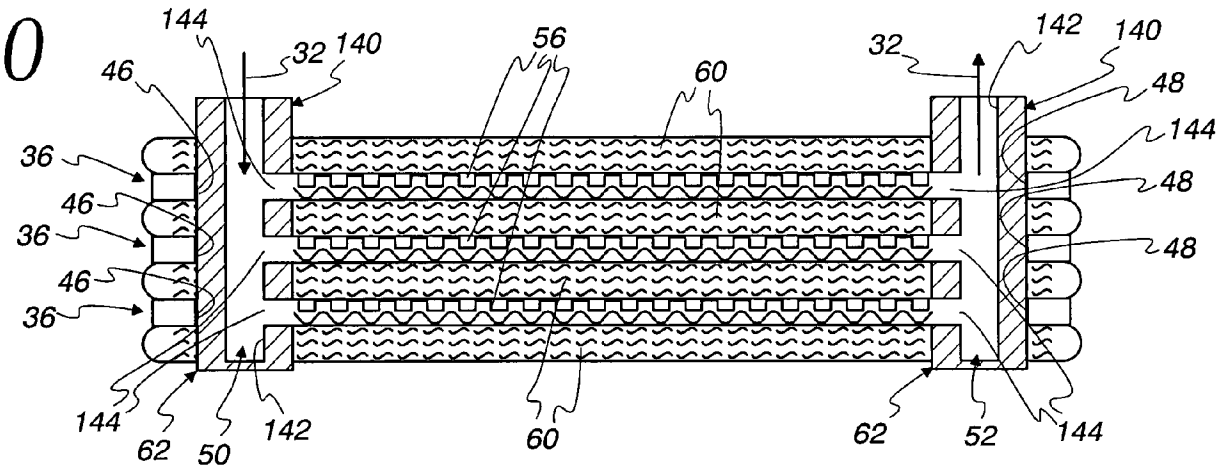
FIGS. 20 and 21 are diagrammatic representations of alternate header constructions for use in the heat exchangers shown in FIGS. 1-19.
Figure 21:
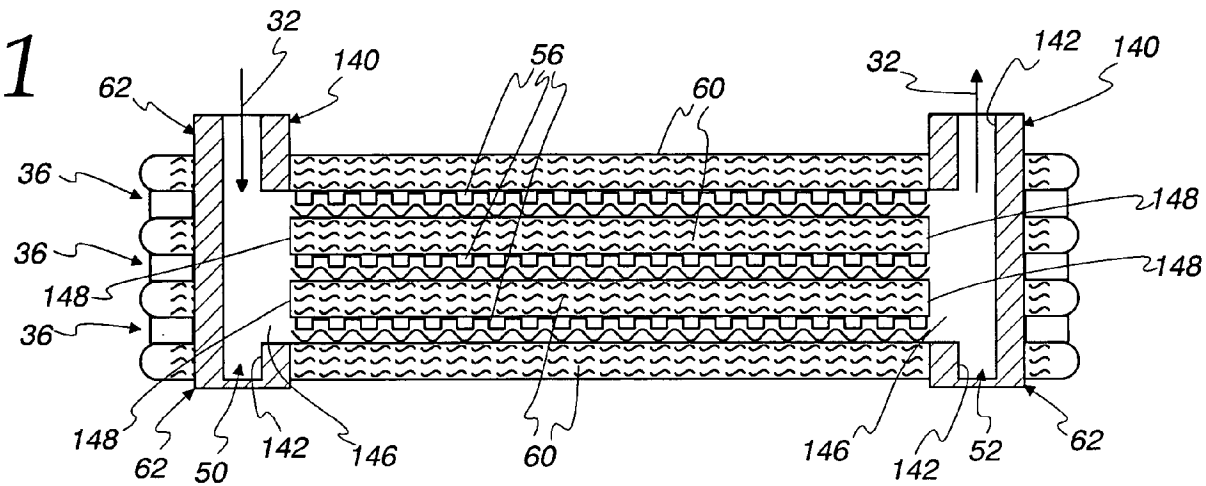

With reference to FIGS. 20 and 21, very diagrammatic representations of the previously described heat exchangers 30 are shown, with the reinforcements 62 being provided in the form of cylindrical header tubes 140 that extends through the respective openings 46 and 48 with a snug or tight fit so that they can be brazed to the mating surfaces of the of the openings 46 and 48 of the subassemblies 36, thereby structurally reinforcing the plates of the subassemblies 36. The manifolds 52 and 54 are then defined by cylindrical bores 142 within the header tubes 140. As seen in FIG. 20, slots 144 that extend from the bore 142 to the exterior of the tube 140 can be provided at locations corresponding to the flow channels 56 in each of the subassemblies 36 to direct the refrigerant 32 to and from the headers 52 and 54. As shown in FIG. 21, the slots 144 can be replaced by one continuous opening 146, which requires that the adjacent subassemblies 36 form a sealed joint 148 at each of the flow paths 60 surrounding the openings 46 and 48 to prevent leakage of the refrigerant 32 into the flow paths 60 for the second fluid 34.

Preferably, the heat exchangers 30 will be assembled and then brazed as an assembled unit, with a constant clamping force being applied the stack of the plates during the brazing process so as to assure the quality of the braze, particularly at the mating surfaces of the plates.

It should be appreciated that the capacity of the heat exchangers 30 can be relatively simply adjusted by adding or subtracting the number of subassemblies 36.

We claim:

1. A transcritical cooling system comprising:

a working fluid flow loop;

a compressor connected to the working fluid flow loop to receive the working fluid therefrom and to compress the working fluid to a supercritical pressure for delivery to the working fluid flow loop; and a brazed plate heat exchanger connected to the working fluid flow loop to receive the working fluid therefrom and return the working fluid thereto, the brazed plate heat exchanger including a plurality of brazed, stacked plate subassemblies that define high pressure flow paths for the working fluid, the brazed plate subassemblies interleaved with a second set of flow paths for another fluid to transfer heat between the working fluid and the second fluid;

wherein the brazed plate heat exchanger comprises:

a plurality of plate pairs defining said subassemblies, each plate pair enclosing a plurality of flow channels extending from a first inlet opening to a first outlet opening, each of the flow channels having a hydraulic diameter less than 1 mm, the plate pairs arranged as a stack with the first inlet openings being aligned with each other to define a first inlet manifold for distributing the first fluid to the flow channels, and the second openings aligned with each other to define a first outlet manifold for collecting the first fluid from the flow channels;

a plurality of turbulator plates interleaved between the plate pairs to define said another set of flow paths for the second fluid, each of the turbulator plates sandwiched between the plate pairs to provide structural support thereto; and reinforcements extending between each of the plate pairs, aligned with the first inlet and outlet openings, and defining the first inlet and outlet manifolds between the plate pairs.

2. The transcritical cooling system of claim 1 wherein the reinforcements comprise a plurality of washers interleaved between the plate pairs.

3. The transcritical cooling system of claim 1 wherein the first inlet and outlet openings are circular openings and each of the washers includes an annular step that is received in a corresponding one of the first inlet and outlet openings.

4. The transcritical cooling system of claim 1 further comprising pairs of channeled plates sandwiched between the plates of each of the plate pairs, grooves extending through each of the channeled plates to define the flow channels with the grooves of the other channeled plate of the pair.

5. The transcritical cooling system of claim 1 wherein the plates of each of the plate pairs are drawn-cup plates, and one of the plates of each of the plate pairs is dimpled to define the flow channels.

6. The transcritical cooling system of claim 1 wherein:

the first inlet and outlet openings are circular openings; and the reinforcements comprise a cylindrical inlet header tube extending through the first inlet openings with an outer surface of the inlet header tube brazed to a surrounding periphery of the inlet openings in each of the plates of each of the plate pairs, and a cylindrical outlet header tube extending through the first outlet openings with an outer surface the outlet header tube brazed to a surrounding periphery of the outlet openings in each of the plates of each of the plate pairs.

7. The transcritical cooling system of claim 6 wherein each of the header tubes includes a plurality of slots, each of the slots aligned with the flow channels of a corresponding plate pair.

8. The transcritical cooling system of claim 1 wherein each of the plate pairs further includes a pair of sealed openings extending through the plate pair, one of the pair of sealed openings in each of the plate pairs being aligned with the one of the pair of sealed openings in the adjacent plate pairs to define a second inlet manifold to distribute the second fluid to the flow paths for the second fluid, the other of the pair of sealed openings in each of the plate pairs being aligned with the other of the pair of sealed openings in the adjacent plate pairs to define a second outlet manifold to collect the second fluid from the flow paths for the second fluid.

9. The transcritical cooling system of claim 1 further comprising:

a top plate defining an upper exterior of the heat exchanger;

a turbulator plate sandwiched between the top plate and an upper-most one of the plate pairs to define flow paths for the second fluid and provide structural support to the plate pairs;

a bottom plate defining a lower exterior of the heat exchanger; and a turbulator plate sandwiched between the bottom plate and a lower-most one of the plate pairs to define flow paths for the second fluid and provide structural support to the plate pairs.

10. The transcritical cooling system of claim 1 wherein each of the turbulator plates is a lanced and offset fin.

11. A transcritical cooling system comprising:

a working fluid flow loop;

a compressor connected to the working fluid flow loop to receive the working fluid therefrom and to compress the working fluid to a supercritical pressure for delivery to the working fluid flow loop; and a brazed plate heat exchanger connected to the working fluid flow loop to receive the working fluid therefrom and return the working fluid thereto, the brazed plate heat exchanger including a plurality of brazed, stacked plate subassemblies that define high pressure flow paths for the working fluid, the brazed plate subassemblies interleaved with a second set of flow paths for another fluid to transfer heat between the working fluid and the second fluid;

wherein said subassemblies are a plurality of flat plate subassemblies, each of the subassemblies comprising a pair of outer flat plates and a pair of channeled plates sandwiched between the outer plates, each of the plates having an inlet opening and an outlet opening spaced from the inlet opening, the inlet openings aligned with each other to define a first inlet manifold, the outlet openings aligned with each other to define a first outlet manifold, each of the channeled plates including a plurality of grooves that cooperate with the grooves of the other channeled plate of the pair to define a plurality of flow channels for the first fluid extending between the inlet openings to the outlet openings of the pair; and wherein said brazed heat exchanger further comprises a plurality of turbulator plates interleaved between the subassemblies to define said another set of flow paths for the second fluid, the turbulator plates sandwiched between the subassemblies to provide structural support thereto; and a plurality of washers aligned with the inlet and outlet openings and interleaved between the subassemblies to provide structural support thereto, with the washers that are aligned with the inlet openings defining the first inlet manifold between the subassemblies, and the washers that are aligned with the outlet openings defining the first outlet manifold between the subassemblies.

12. The transcritical cooling system of claim 11 wherein the inlet and outlet openings in the outer plates are circular openings and each of the washers includes an annular step that is received in a corresponding one of the inlet and outlet openings in the outer plates without extending through the outer plate.

13. The transcritical cooling system of claim 11 wherein the grooves in one of the channeled plates of each pair extend longitudinally between the inlet and outlet openings, and the grooves in the other channeled plate of the pair extend transverse to the grooves in the one of the channeled plates.

14. The transcritical cooling system of claim 11 wherein each of the subassemblies further includes a pair of sealed openings extending through the subassembly, one of the pair of sealed openings in each of the subassemblies being aligned with the one of the pair of sealed openings in the adjacent subassemblies to define an second inlet manifold to distribute the second fluid to the flow paths for the second fluid, the other of the pair of sealed openings in each of the subassemblies being aligned with the other of the pair of sealed openings in the adjacent subassemblies to define a second outlet manifold to collect the second fluid from the flow paths for the second fluid.

15. The transcritical cooling system of claim 14 further comprising a plurality of spacer plates interleaved between the subassemblies, each of the spacer plates sandwiched between an adjacent pair of the subassemblies and surrounding the turbulator plate and the washers sandwiched between the adjacent pair to enclose a flow space for the second fluid.

16. The transcritical cooling system of claim 11 further comprising:

a top plate defining an upper exterior of the heat exchanger;

a turbulator plate sandwiched between the top plate and an upper-most one of the plate subassemblies to define flow paths for the second fluid and provide structural support to the subassemblies;

a bottom plate defining a lower exterior of the heat exchanger; and a turbulator plate sandwiched between the bottom plate and a lower-most one of the subassemblies to define flow paths for the second fluid and provide structural support to the subassemblies.

17. The transcritical cooling system of claim 11 wherein each of the turbulator plates is a lanced and offset fin.

* * * * *